US006149113A

United States Patent [19]

Chen

[11] Patent Number: 6,149,113

[45] Date of Patent: Nov. 21, 2000

[54] APPARATUS FOR LOCATING BASE OF EXERCISE DEVICE

[76] Inventor: James Chen, No. 35, Tun Hi Rd., Chin Chan Li, Sa Lu, Taichung, Taiwan

[21] Appl. No.: 09/207,417

[22] Filed: Dec. 8, 1998

[51] Int. Cl.[7] ..... A47B 91/00

[52] U.S. Cl. ..... 248/188.9; 248/345.1; 248/506

[58] Field of Search ..... 248/188.1, 188.5, 248/188.7, 188.9, 357, 346.01, 346.4, 501, 502, 508, 188.8, 345.1

[56] References Cited

U.S. PATENT DOCUMENTS

| | | | |
|---|---|---|---|
| 3,322,389 | 5/1967 | Janin | 248/345.1 |
| 3,633,863 | 1/1972 | Abbey | 248/346.1 |
| 3,729,226 | 4/1973 | Barecki | 297/232 |
| 3,796,169 | 3/1974 | Bales et al. | 108/116 |
| 4,412,667 | 11/1983 | Doerner | 248/188.7 |
| 5,275,369 | 1/1994 | Kamata et al. | 248/345.1 |
| 5,494,333 | 2/1996 | Wilson | 297/344.18 |

*Primary Examiner*—Ramon O. Ramirez
*Assistant Examiner*—Walter Landry
*Attorney, Agent, or Firm*—Browdy and Neimark

[57] ABSTRACT

An apparatus for locating the base of an exercise device on a surface is made integrally of a plastic material by injection molding. The apparatus has a seat which is provided in the underside thereof with a plurality of skidproof protuberances, and at one end thereof with a main body extending upwards. The main body is provided with a body portion extending toward other end of the seat. The body portion is smaller in size than the main body and provided with a ring-shaped insertion area. The main body is further provided with two stop shoulders for locating a tubular body of the base of the exercise device. The upper wall surface of the tubular body of the base of the exercise device is flush with the upper surface of the main body when the apparatus is joined with the tubular body of the base of the exercise device.

6 Claims, 2 Drawing Sheets

APPARATUS FOR LOCATING BASE OF EXERCISE DEVICE

FIELD OF THE INVENTION

The present invention relates generally to an accessory of an exercise device, and more particularly to a skidproof apparatus for locating the base of the exercise device on a surface.

BACKGROUND OF THE INVENTION

The tubular base of the conventional exercise machine is generally provided with a plurality of base locating devices of a plastic material. These plastic devices serve to locate the exercise machine on a floor surface. In addition, the plastic devices are intended to cover the ends of the tubular base for enhancing the esthetic effect of the base and for providing the exerciser with protection.

Such a conventional locating device of the plastic material as described above is not effective in locating the base of the exercise device in view of the fact that the seesaw action between the exerciser and the exercise device can cause the locating devices to slide on the floor surface. In addition, the locating devices are vulnerable to damage or deformation after a prolonged use.

SUMMARY OF THE INVENTION

It is therefore the primary objective of the present invention to provide an apparatus for locating effectively the base of an exercise device on a surface.

It is another objective of the present invention to provide an apparatus for locating effectively the base of an exercise device on a surface. The apparatus is so constructed that it is securely fastened to the base of the exercise device.

In keeping with the principle of the present invention, the foregoing objectives of the present invention are attained by the apparatus which is made integrally of a plastic material by injection molding and composed of a seat provided on the underside thereof with a plurality of protuberances, and at one end thereof with a main body extending upwards. The main body is provided with a body portion extending toward the other end of the seat. The body portion is smaller in size than the main body and provided with a ring-shaped insertion area. The main body is further provided with two stop shoulders for locating the tubular body when the tubular body is joined with the body portion of the main body. The upper surface of the tubular body is coplanar with the upper surface of the main body for enhancing the esthetic effect of the base of the exercise device. The protuberances of the base afford a skidproof effect.

DETAILED DESCRIPTION OF THE INVENTION

Figure 1:
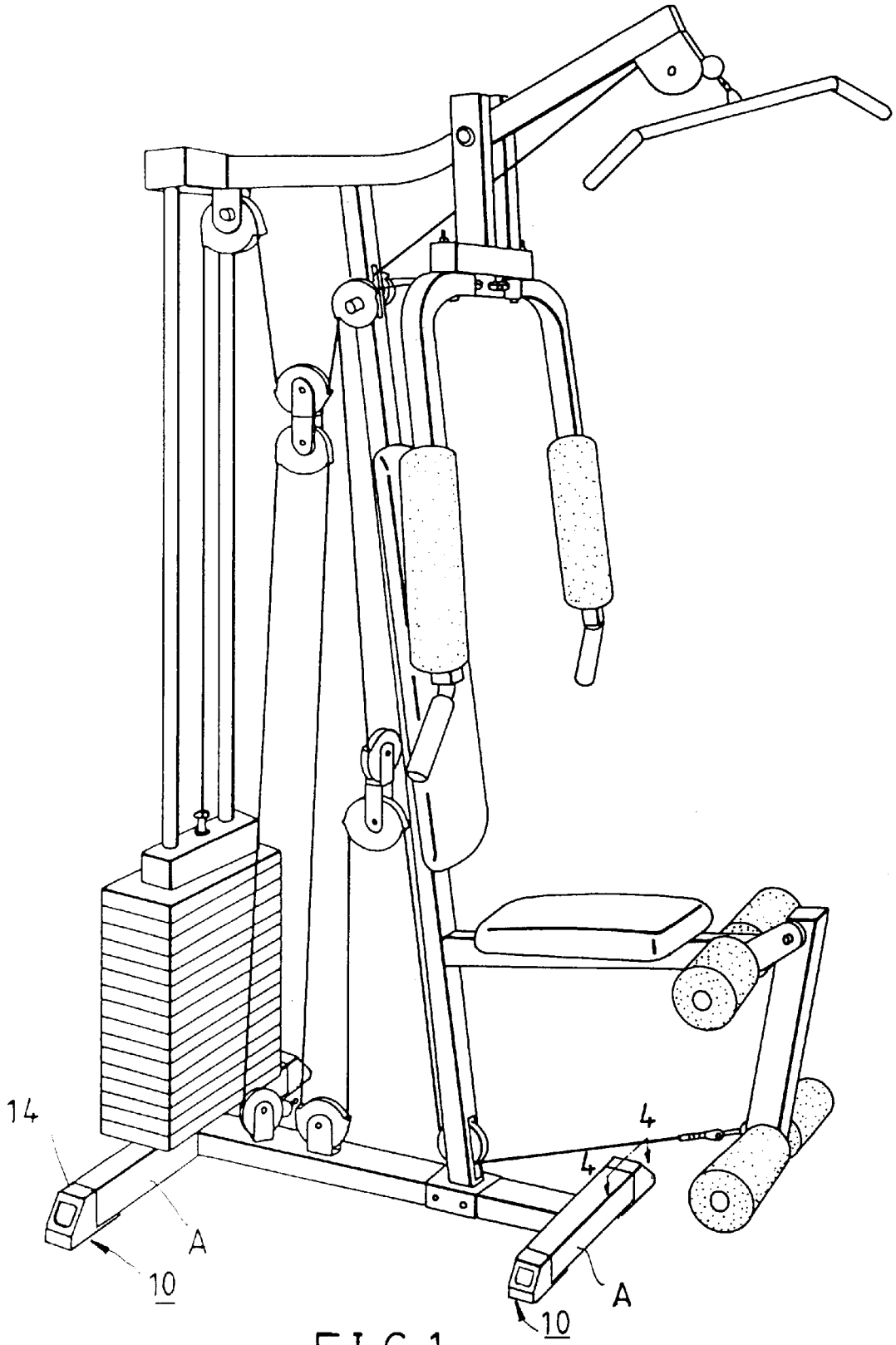
FIG. 1 shows a perspective view of a preferred embodiment of the present invention.
Figure 2:
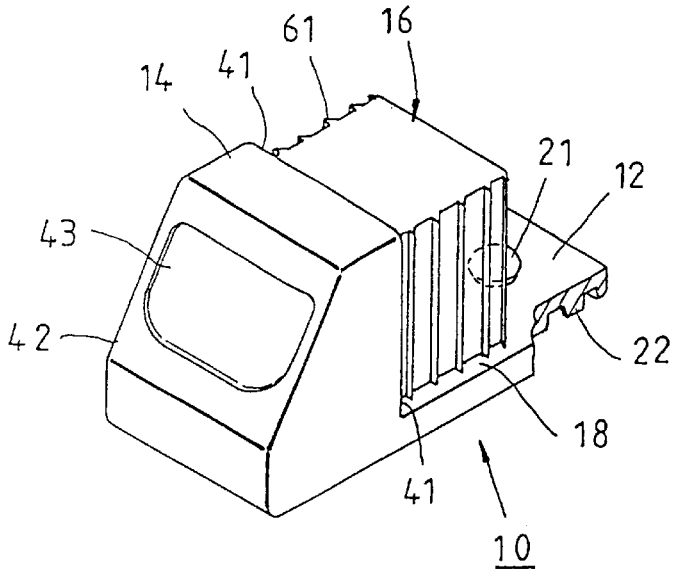
FIG. 2 shows a plan view of the preferred embodiment of the present invention.
Figure 3:
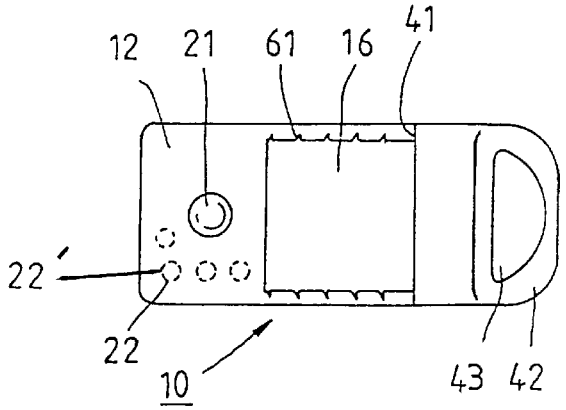
FIG. 3 shows a schematic view of the preferred embodiment of the present invention at work.

As shown in FIGS. 1–3, a skidproof apparatus 10 embodied in the present invention is made integrally of a plastic material by injection molding and is fastened with the ends of the tubular body "A" of the base of an exercise device.

The apparatus 10 has a seat 12 which is provided at one end thereof with a main body 14 extending upwards. The main body 14 is made integrally with the seat 12. The seat 12 is further provided with a body portion 16 extending toward the other end of the seat 12. The body portion 16 is shorter than the seat 12 and smaller in size than the main body 14. The body portion 16 is provided with a ring-shaped insertion area 18. The main body 14 is provided with two stop shoulders 41.

Figure 4:
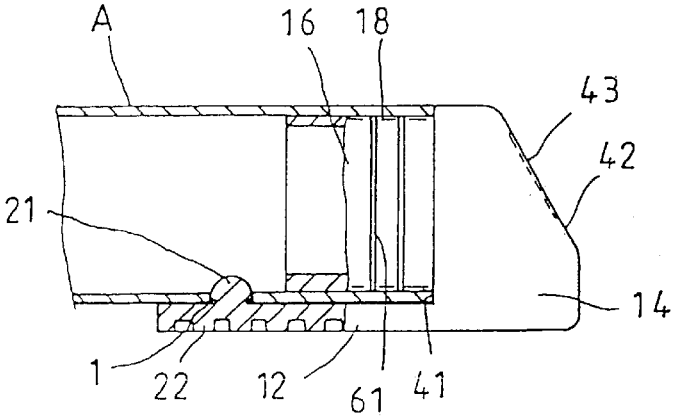
FIG. 4 shows a sectional view of a portion taken along the direction indicated by a line 4—4 as shown in FIG. 3.

The seat 12 is provided at the center of the upper portion thereof with a tenon 21 having an arcuate head. The tubular body "A" of the base of the exercise device is provided with a mortise 1 corresponding in location to and engageable with the tenon 21. The seat 12 is provided in the underside thereof with a plurality of skidproof protuberances 22 of a columnar construction having a circular cross-section 22. The protuberances 22 are spaced apart at intervals As shown in FIG. 4 the main body 14 has an inclined front end surface 42 with an inclination of over 45 degrees to the plane of seat 12. The main body 14 is provided in the center thereof with a recessed portion 43 for marking the trademark or the name of the manufacturer of the apparatus 10.

The body portion 16 is of a hollow tubular construction and is dimensioned to fit into the tubular body "A" of the base of the exercise device. In light of the tubular body "A" being square in its cross section, the body portion 16 of the preferred embodiment of the present invention is also square in its cross section. The body portion 16 is provided in two opposite peripheral surfaces thereof with a plurality of ribs 61 which are longitudinally oriented and are of a ratchetlike construction. When the body portion 16 is joined with the tubular body"A", the ribs 61 are forced to deform so as to prevent the body portion 16 from being disengaged with the tubular body "A".

As shown in FIGS. 3 and 4, the body portion 16 of the skidproof apparatus 10 of the present invention is fitted into the tubular body "A" of the base of the exercise device such that the wall of the tubular body "A" is located at the insertion area 18, and that the end of the tubular body "A" is located at the two stop shoulders 41, and further that the tenon 21 of the seat 12 is retained in the mortise 1 of the tubular body "A", and further that the wall of the tubular body "A" is arrested by the ribs 61 of the body portion 16 of the apparatus 10. The seat 12 is rested on a surface. The protuberances 22 of the seat 12 serve to provide an added friction between the seat 12 and the surface so as to locate effectively the base of the exercise device on the surface.

As shown in FIG. 4, the main body 14 has an upper surface which is flush with the upper side wall surface of the tubular body "A" for enhancing the esthetic effect of the base of the exercise device. The recessed portion 43 of the main body 14 may be used for marking the trademark or the name of the manufacturer of the apparatus 10 of the present invention.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An apparatus adapted for locating a base of an exercise device on a surface the base of the exercise device having a tubular body with a free end, an upper wall surface and a mortise, said apparatus being made integrally of a plastic material by injection molding and composed of a seat which is provided on an underside thereof with a plurality of protuberances which are each columnar and have a circular cross-section, said protuberances being spaced apart at intervals, said seat further provided at one end thereof with a main body extending upwards and having a body portion which is smaller in size than said main body, said body portion provided with an insertion area, said main body provided with two stop shoulders for engaging the free end of the tubular body of the base of the exercise device at the time when said apparatus is joined with the tubular body and, wherein said body portion is provided in the outer peripheral surfaces thereof with a plurality of ribs for holding said body portion and the tubular body of the base of the exercise device together.

2. The apparatus define in claim 1, wherein said main body has an upper surface which is flush with the upper wall surface of the tubular body of the base of the exercise device.

3. The apparatus as define in claim 1, wherein a tenon is formed as a unitary body with said seat and can be engaged with the mortise of the tubular body of the base of the exercise device.

4. The apparatus as defined in claim 1, wherein said main body is provided at a front end thereof with an inclined surface which is provided with a recessed portion.

5. The apparatus as defined in claim 1, wherein said body portion is of a hollow tubular construction.

6. The apparatus as defined in claim 4, wherein an inclination of the inclined surface to a plane of the base is over 45°.

* * * * *